US006537034B2

(12) United States Patent
Park et al.

(10) Patent No.: US 6,537,034 B2
(45) Date of Patent: Mar. 25, 2003

(54) APPARATUS AND METHOD FOR CONTROLLING OPERATION OF LINEAR COMPRESSOR

(75) Inventors: Joon Hyung Park, Seoul (KR); Yin Young Hwang, Anyang (KR); Jin Koo Park, Gwangmyeong (KR); Yang Kyu Kim, Seoul (KR); Se Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/989,421

(22) Filed: Nov. 21, 2001

(65) Prior Publication Data

US 2002/0064463 A1 May 30, 2002

(30) Foreign Application Priority Data

Nov. 29, 2000 (KR) ..... 00/71657
Nov. 29, 2000 (KR) ..... 00/71658
Nov. 29, 2000 (KR) ..... 00/71659
Nov. 29, 2000 (KR) ..... 00/71660

(51) Int. Cl.[7] ..... F04B 49/06

(52) U.S. Cl. ..... 417/44.1; 417/53; 417/45; 417/18; 417/44.11; 417/212; 417/417

(58) Field of Search ..... 417/53, 44.1, 45, 417/18, 44.11, 212, 417

(56) References Cited

U.S. PATENT DOCUMENTS 4,783,807 A * 11/1988 Marley ..... 381/43
5,947,693 A * 9/1999 Yang ..... 417/45
5,980,211 A * 11/1999 Tojo et al. ..... 417/45
6,084,320 A * 7/2000 Morita et al. ..... 310/12
6,153,951 A * 11/2000 Morita et al. ..... 310/12
6,176,683 B1 * 1/2001 Yang ..... 417/44.1
6,231,310 B1 * 5/2001 Tojo et al. ..... 417/44.1
6,289,680 B1 * 9/2001 Oh et al. ..... 62/6

* cited by examiner

*Primary Examiner*—Charles G. Freay
*Assistant Examiner*—William H Rodriguez
(74) *Attorney, Agent, or Firm*—Birch, Stewart, Kolasch & Birch, LLP

(57) ABSTRACT

An apparatus for controlling an operation of a linear compressor includes: a sensorless circuit unit for detecting a current and a voltage applied to a linear compressor and outputting a work operation value corresponding to them; a stroke controller for receiving the work operation value and outputting a switching control signal corresponding to a variation amount of the work operation value; and an electric circuit unit for receiving the switching control signal from the stroke controller and outputting a certain voltage to the linear compressor, accordingly, a TDC of the piston in consideration of an error due to the nonlinear characteristic can be controlled, and thus, an operation efficiency of the linear compressor can be improved.

3 Claims, 17 Drawing Sheets

APPARATUS AND METHOD FOR CONTROLLING OPERATION OF LINEAR COMPRESSOR

BACKGROUND OF THE INVENTION

1. Field of the Invention

The present invention relates to an apparatus and method for controlling an operation of a linear compressor, and more particularly, to an apparatus and method for controlling an operation of a linear compressor in which a work operation value is obtained by using a current and a voltage and a stroke is controlled with a variation amount of a size of the work operation value.

2. Description of the Background Art

In general, a compressor serves to heighten a pressure of a coolant vapor (that is, to compress the vapor) so that the coolant vapor evaporated from an evaporator can be easily condensed.

According to the operation of the compressor, the coolant is repeatedly condensed and evaporated, circulating in a freezing device, to carry heat from a cold place to a warm place.

These days, there are various types compressors are in use, of which a reciprocating compressor is the most widely used.

The reciprocating compressor uses a method in which vapor is compressed by a piston which moved vertically within a cylinder to thereby heighten a pressure. In addition, since a compression ratio can be varied by varying a stroke voltage applied to the reciprocating compressor, the reciprocating compressor can be also used to control a variable cooling force.

However, the reciprocating compressor is to compress vapor by changing a rotational movement of a motor to a linear movement, for which, thus, a mechanic converting device, such as a screw, a chain, a gear system or a timing belt, is requisite for converting the rotational movement to the linear movement.

Thus, its energy conversion loss is great and the structure of the device is complicate, so that, recently, a linear compressor adopting a linear method allowing a motor itself to make a linear movement is favorably used.

The linear compressor has advantages that, since the motor itself directly generates a linear driving force, it does not need a mechanical conversion device, and thus, its structure is not complicate and a loss due to an energy conversion can be reduced.

In addition, since there is no connection region where friction and abrasion are inevitably generated, its noise can be much reduced.

Moreover, in case that the linear compressor is used for a refrigerator or an air-conditioner, since the compression ratio can be varied by varying a stroke voltage applied to the linear compressor, the linear compressor can be used to control a variable cooling force.

FIG. 1 is a schematic block diagram showing the construction of an apparatus for controlling an operation of a general linear compressor.

As shown in FIG. 1, an apparatus for controlling an operation of a linear compressor includes: a linear compressor 3 for varying a stroke (a distance between a top dead center and a bottom dead center) according to a reciprocal movement of a piston by a stroke voltage, to thereby control a cooling force (a freezing capacity); a current detecting unit 4 for detecting a current applied to the linear compressor 3 according to a stroke variation; a voltage detecting unit 5 for detecting a voltage generated at the linear compressor 3 by a stroke variation; a microcomputer 6 for computing a stroke by using the current and the voltage detected by the current detecting unit 4 and the voltage detecting unit 5, comparing the computed stroke with a stroke command value as inputted by a user and outputting a switching control signal; and an electric circuit unit 1 for switching an AC power with a traic 2 according to the outputted switching control signal and applying a stroke voltage to the linear compressor 3.

The control operation of the linear compressor constructed as described above will now be explained.

First, the electric circuit unit 1 outputs a stroke voltage according to a stroke command value as set by the user, and controls a cooling force of the linear compressor 3 as the piston performs a reciprocal movement according to the stroke voltage and the stroke (the distance between the top dead center and the bottom dead center of the piston) is varied.

That is, the linear compressor 3 controls the cooling force in such a manner that the stroke is varied according to the reciprocal movement of the piston within the cylinder and the cooling gas inside the cylinder is discharged through a discharge valve to a condenser.

When the stroke is varied according to the stroke voltage, the current detecting unit 4 and the voltage detecting unit 5 detect a voltage and a current generated from the linear compressor 3, respectively, and the microcomputer 6 computes the stroke with the detected voltage and the current.

If the computed stroke is smaller than a stroke command value, the microcomputer 5 outputs a switching control signal which renders an ON period of the traic to be lengthened, to thereby increase the stroke voltage applied to the linear compressor 3.

If, however, the computed stroke is greater than a stroke command value, the microcomputer 6 outputs a switching control signal for rendering the ON period of the traic to be shortened, to thereby reduce the stroke voltage applied to the compressor 3.

However, the conventional apparatus for controlling an operation of a linear compressor has a non-linearity having a severe mechanical movement characteristic. Thus, without considering the non-linearity, a precise controlling is not possible with the linear control method.

SUMMARY OF THE INVENTION

Therefore, an object of the present invention is to provide an apparatus and method for controlling an operation of a linear compressor that are capable of controlling a top dead center (TDC) of a piston in consideration of an error according to a non-linear characteristic by obtaining a work operation value by using a current and a voltage and controlling a stroke with a variation amount of a size of the work operation value, and thereby improving an operation efficiency of the linear compressor.

To achieve these and other advantages and in accordance with the purpose of the present invention, as embodied and broadly described herein, there is provided an apparatus for controlling an operation of a linear compressor comprising: a sensorless circuit unit for detecting a current and a voltage applied to a linear compressor and outputting a work operation value corresponding to them; a stroke controller for receiving the work operation value and outputting a switching control signal according to a variation amount of the work operation value; and an electric circuit unit for receiving the switching control signal from the stroke controller and outputting a certain voltage to the linear compressor.

To achieve the above objects, there is further provided a method for controlling an operation of a linear compressor including the steps: inputting a stroke command value by a user; detecting a current and a voltage generated when the linear compressor is driven according to the stroke voltage; detecting a work operation value with the detected current and voltage; receiving the work operation value and comparing it with a previous work operation value; outputting a switching control signal if a variation amount of the compared work operation values satisfies a predetermined value; and switching an AC power with a traic according to the switching signal, applying the stroke voltage to the linear compressor, and driving the compressor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
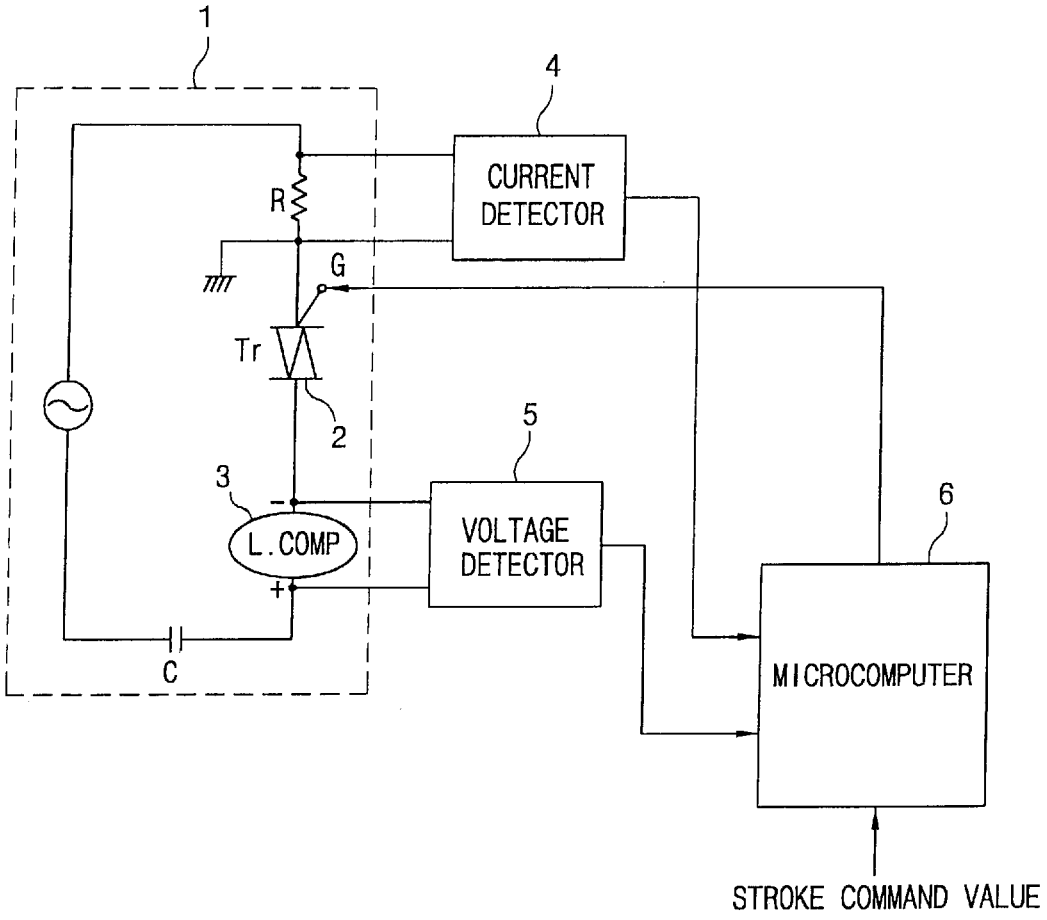
FIG.1 CONVENTIONAL ART
FIG. 1 is a schematic block diagram showing the construction of an apparatus for controlling an operation of a general linear compressor.
Figure 2:
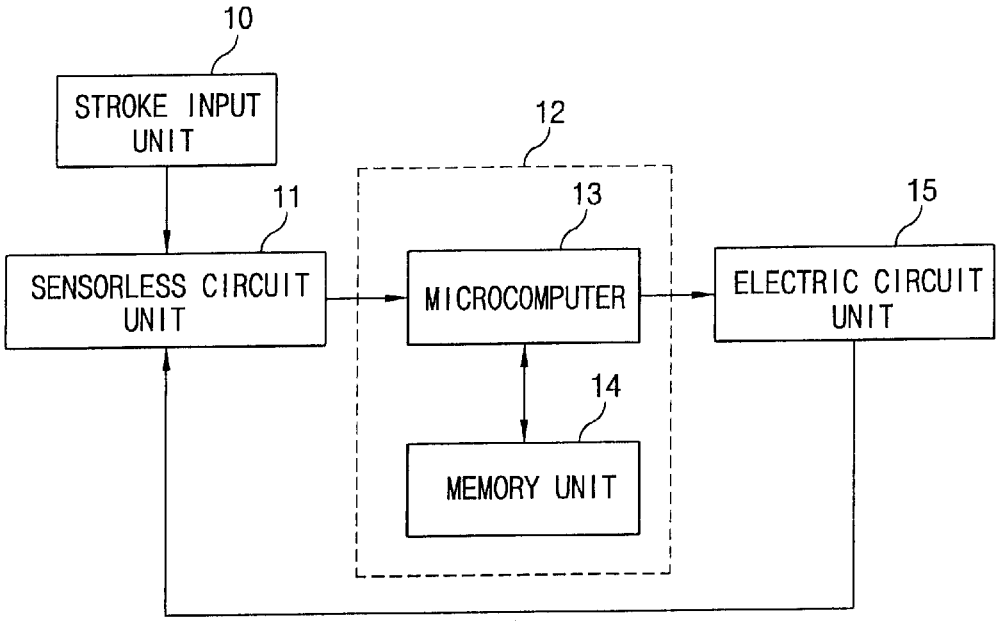
FIG. 2 is a schematic block diagram showing the construction of an apparatus for controlling an operation of a linear compressor in accordance with a first embodiment of the present invention.

FIG. 2 is a schematic block diagram showing the construction of an apparatus for controlling an operation of a linear compressor in accordance with a first embodiment of the present invention.

As shown in FIG. 2, the apparatus for controlling an operation of a linear compressor includes: a stroke input unit 10 for outputting a stroke command value according to a user's input; a sensorless circuit unit 11 for detecting a current and a voltage applied to the linear compressor and outputting a work operation value corresponding to them; a stroke controller 12 for receiving the work operation value and outputting a switching control signal according to the variation amount of the work operation value; and an electric circuit unit 15 for receiving the switching control signal from the stroke controller and outputting a certain voltage to the linear compressor.

The stroke controller 12 includes: a memory unit 14 for sequentially storing the work operation values and a microcomputer 13 for receiving a previous work operation value outputted from the memory unit 14 and the work operation value outputted from the sensorless circuit unit 11, comparing them and outputting a switching control signal.

The electric circuit unit 15 includes a triac for receiving the switching control signal from the stroke controller 12, switching an AC power, and applying a stroke voltage to the linear compressor.

The operation of the apparatus for controlling an operation of a linear compressor constructed as described above will now be explained in detail.

First, the linear compressor generates a stroke voltage according to a stroke command value outputted according to a user's input, and a piston is reciprocally moved according to the stroke voltage, according to which the stroke is varied to control a cooling force.

That is, a voltage and a current generated at the linear compressor are detected and applied to the sensorless circuit unit 11. Then, the sensorless circuit unit 11 computes a work operation value by using the voltage and the current and outputs the work operation value to the stroke controller 12.

Then, the stroke controller 12 compares the previous work operation value stored in the memory unit 12 and the work operation value inputted from the sensorless circuit unit 11, and outputs a switching control signal according to the variation amount of the work operation value to the electric circuit unit 15.

Accordingly, as the ON/OFF period of the triac of the electric circuit unit 15 is varied according to the switching control signal of the microcomputer 13, the stroke is varied and the linear compressor is driven by the stroke.

Figure 3:
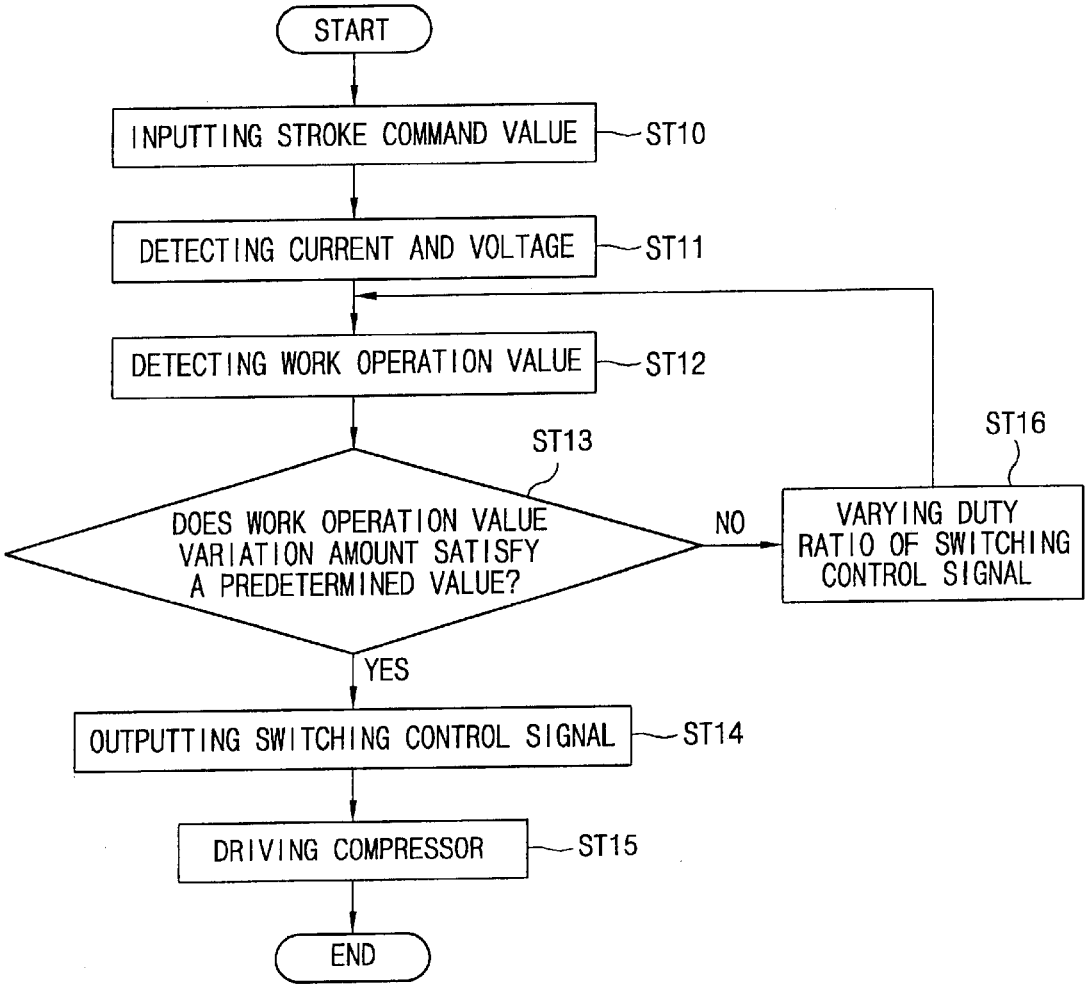
FIG. 3 is a flow chart of a method for controlling an operation of a linear compressor in accordance with the first embodiment of the present invention.

FIG. 3 is a flow chart of a method for controlling an operation of a linear compressor in accordance with the first embodiment of the present invention.

As shown in FIG. 3, the method for controlling an operation of a linear compressor includes the steps of: inputting a stroke command value according to a user's input information (step S10); detecting and outputting a current and a voltage generated when the linear compressor is driven by a stroke voltage (step S11); detecting and outputting a work operation value by using the detected current and voltage (step S12); receiving the work operation value, comparing it with a previous work operation value, and outputting a variation amount of the work operation value (step S13); outputting a switching control signal if the variation amount of the work operation value satisfies a predetermined value (step S14); switching an AC power with a triac according to the switching control signal, applying the stroke voltage to the linear compressor and driving a linear compressor (step S15).

The work operation value comparing step (step S13) includes a step (step S16) of varying a duty ratio of the switching control signal if the variation amount of the work operation value does not correspond to the predetermined value after the detected work operation value and the stored work operation value are compared.

The switching control signal controls the ON/OFF period of the triac by using the work operation value corresponding to the current and the voltage when the TDC is '0 '.

Meanwhile, in a second embodiment of the present invention, a work operation value (Wi), an integrated value of a size of the current consumed by the compressor, is computed and the linear compressor can be driven by using variation information of the size of the work operation value (Wi).

Figure 4:
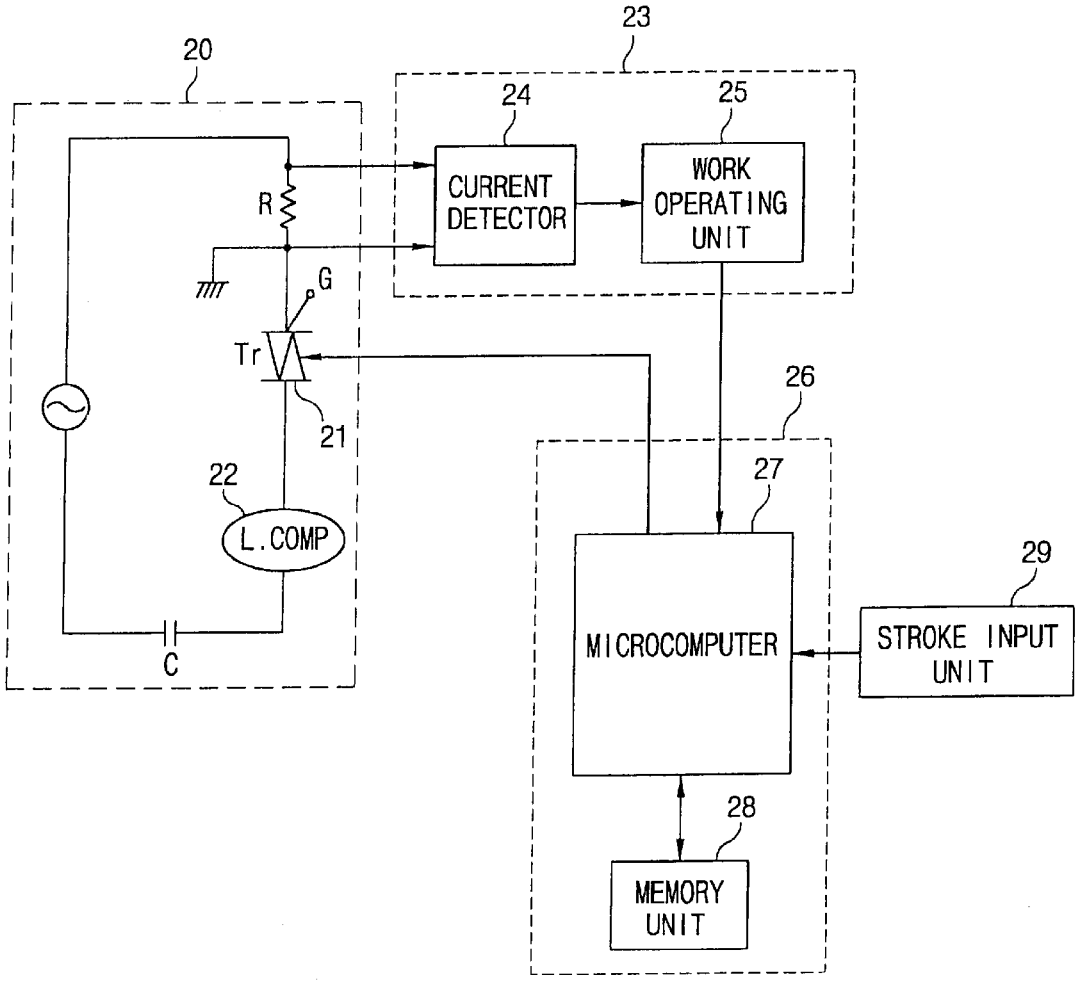
FIG. 4 is a schematic block diagram showing the construction of an apparatus for controlling an operation of a linear compressor in accordance with a second embodiment of the present invention.

FIG. 4 is a schematic block diagram showing the construction of an apparatus for controlling an operation of a linear compressor in accordance with a second embodiment of the present invention;

As shown in FIG. 4, a sensorless circuit unit 23, which detects a current and a voltage applied to the linear compressor 22 and outputs a corresponding work operation signal, includes a current detector 24 for detecting a current applied to the linear compressor 22 and a work operating unit 25 for receiving the current of the current detector 24, integrating it for one period and outputting a corresponding work operation value (Wi).

A stroke controller 26, which receives the work operation value and outputs a corresponding switching control signal, includes a memory unit 28 for sequentially storing the work operation value, and a microcomputer 27 for receiving a previous work operation value outputted from the memory unit 28 and the predetermined work operation value outputted from the work operating unit, comparing them, and outputting a switching control signal corresponding to the variation amount of the work operation value.

The apparatus for controlling an operation of a linear compressor in accordance with the second embodiment of the present invention includes: a stroke input unit 29 for outputting a predetermined stroke command value according to a user's input; a linear compressor 22 for varying a stroke according to a reciprocal movement of a piston and controlling a cooling force; a current detector 24 for detecting a current applied to the linear compressor; a work operating unit 25 for receiving a current of the current detector, integrating it for one period and outputting a corresponding work operation value (Wi); a memory unit 28 for sequentially storing the work operation values; a microcomputer 27 for receiving the previous work operation value outputted from the memory unit and the predetermined work operation value outputted from the work operating unit, comparing them, and outputting a switching control signal corresponding to a variation amount of the work operation value; and an electric circuit unit 20 for switching an AC current with a triac according to the switching control signal of the microcomputer and applying a stroke voltage to the linear compressor.

The operation of the apparatus for controlling an operation of a linear compressor 22 constructed as described above will now be explained in detail.

First, in the linear compressor 22, the piston is reciprocally moved by the stroke voltage according to the stroke command value set by the user, and accordingly, the stroke is varied to control a cooling force.

That is, the ON period of the triac 21 of the electric circuit unit 20 is lengthened by the switching control signal of the microcomputer 27 and the stroke is increased, the linear compressor 22 is driven by the stroke. At this time, the current detector 24 detects a current generated at the linear compressor 22.

The work operating unit 25 receives the detected current from the current detector 24, integrates the detected current for one period, and outputs the integrated value as a work operation value (Wi), which is expressed by equation (1) shown below.

$$Wi=\int |i|, \text{ integration section is in the unit of } 1/60 \text{ seconds} \quad (1)$$

Figure 5:
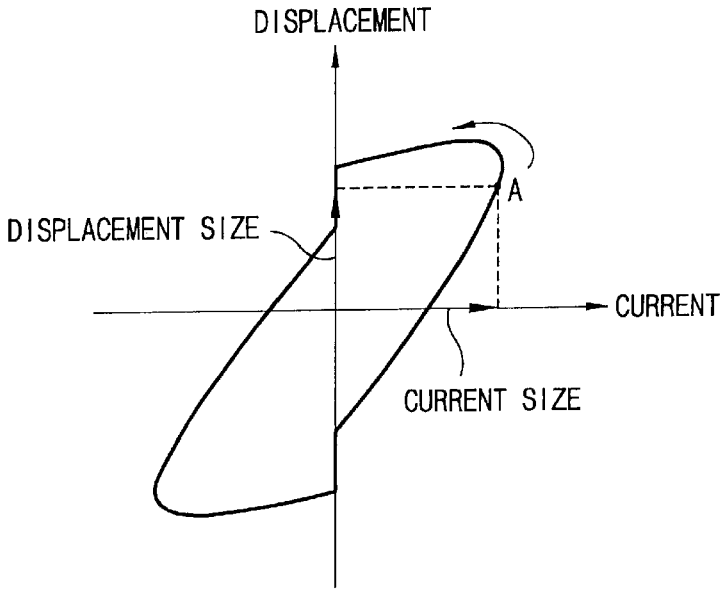
FIG. 5 is an exemplary view showing a trajectory of a current and a displacement according to the lapse of time, after the linear compressor is initiated.

FIG. 5 is an exemplary view showing a trajectory of a current and a displacement according to the lapse of time, after the linear compressor 22 is initiated, in which 'A' is one point of the trajectory corresponding to the current and the displacement, and the movement of the trajectory for the current and the displacement is repeated for every 1/60 seconds in synchronization with a power supply frequency supplied tot he linear compressor 22.

Thereafter, the microcomputer 27 receives a work operation value (Wi) of the work operating unit 25, compares it with the previous work operation value (Wi), and outputs a corresponding switching control signal.

Figure 6:
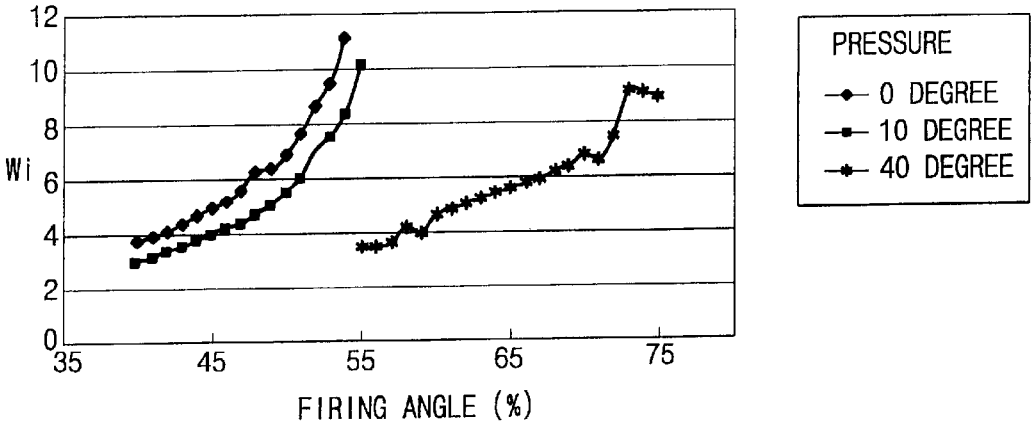
FIG. 6 is a graph illustrating a point where a TDC is '0' in accordance with the second embodiment of the present invention.

FIG. 6 is a graph illustrating a point where a TDC is '0' in accordance with the second embodiment of the present invention.

As shown in FIG. 6, there is a point where a difference between the current work operation value (Wi) and the previous work operation value (Wi) is sharply increased more than a predetermined value as a firing angle (a conducting time for every one cycle of AC power), and according to an experiment, the point is was where the TDC is '0'.

Figure 7:
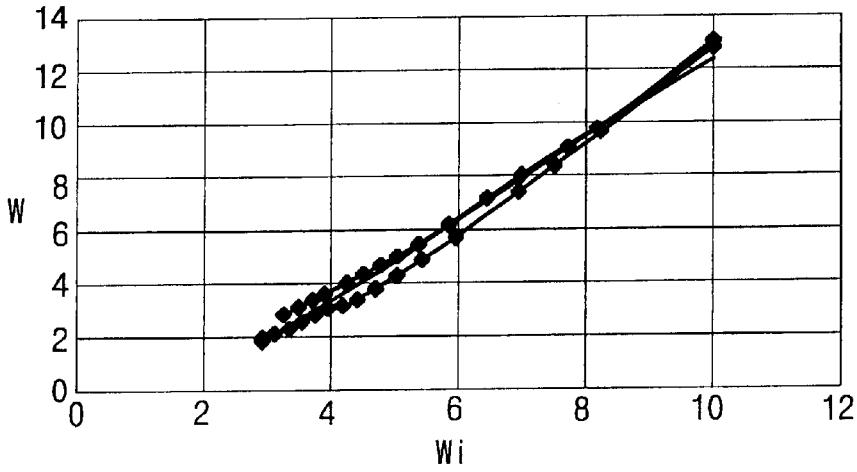
FIG. 7 is a graph showing a relationship between a work operation value according to a displacement and a current and a work operation value according to a current in accordance with second embodiment of the present invention.

FIG. 7 is a graph showing a relationship between a work operation value according to a displacement and a current and a work operation value according to a current in accordance with second embodiment of the present invention, in which the work operation value (Wi) and the work operation value (W) have almost the same characteristic.

Accordingly, the microcomputer 27 compares the current work operation value (Wi) and the previous work operation value (Wi), and if a difference between them is less than a predetermined value, the microcomputer 27 outputs the switching control signal while gradually increasing its duty ratio, and then, if the difference between the current work operation value (Wi) and the previous work operation value (Wi) becomes more than the predetermined value, the microcomputer 27 maintains the switching control signal having a duty ratio of the current time point and outputs it.

Thereafter, the electric circuit unit 20 switches the AC power with the triac 21 according to the switching control signal of the microcomputer 27 and applies a corresponding stroke voltage to the linear compressor 22, thereby controlling the operation of the linear compressor 22.

That is, the work operation value (Wi) is generated by using an integrated value of the current generated during operation of the linear compressor 22, and while the duty ratio of the switching control signal applied to the triac 21 of the electric circuit unit 20 is increasing, the time point when the work operation value (Wi) is sharply increased higher than the previous work operation value (Wi) is recognized as a point where the TDC is '0', and the ON/OFF period of the triac 21 is controlled with the switching control signal at the time point, to control the operation of the linear compressor.

Figure 8:
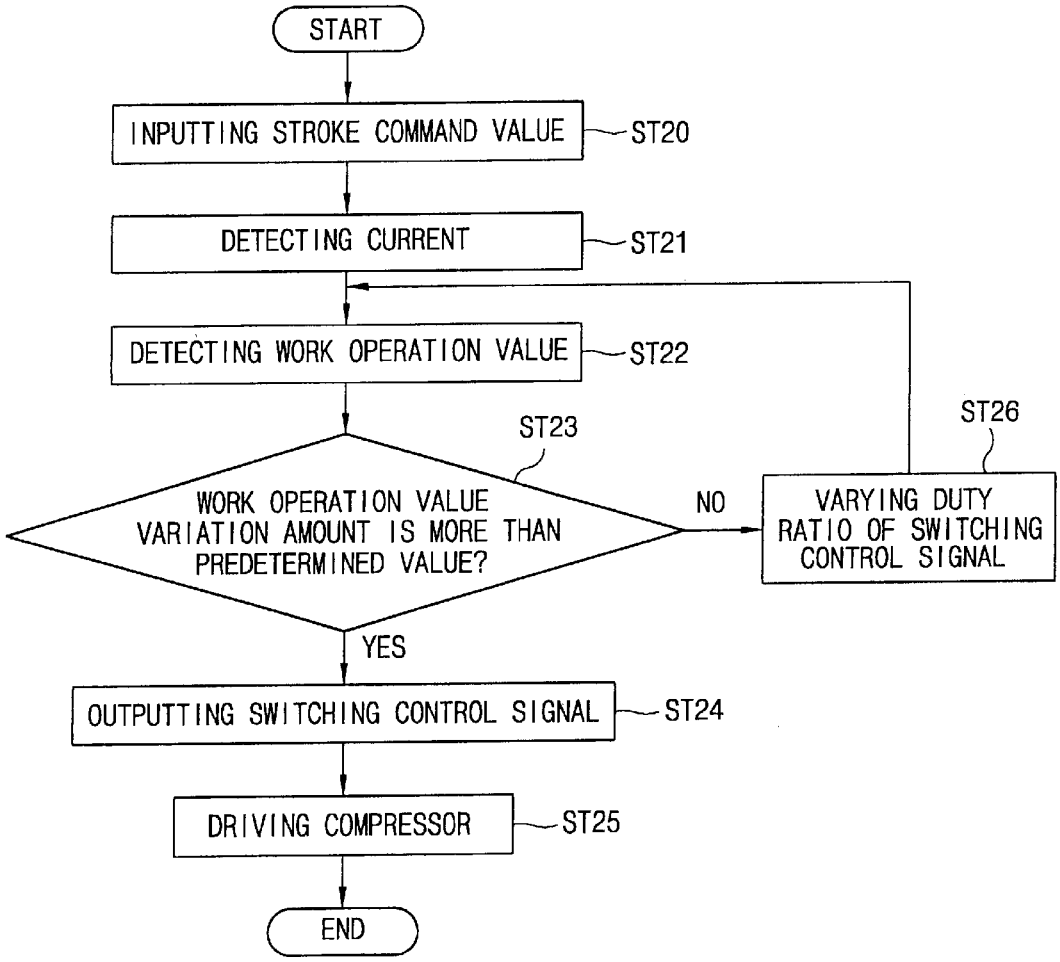
FIG. 8 is a flow chart of a method for controlling an operation of a linear compressor for integrating a size of a current consumed by the linear compressor to obtain a work operation value and controlling a stroke with a variation amount of the size of the work operation value.

FIG. 8 is a flow chart of a method for controlling an operation of a linear compressor for integrating a size of a current consumed by the linear compressor to obtain a work operation value and controlling a stroke with a variation amount of the size of the work operation value.

As shown in FIG. 8, a method for controlling an operation of a linear compressor includes the steps of: outputting a stroke command value according to a user's input information (step ST20); detecting a current generated when the linear compressor driven according to the stroke voltage (step S21); receiving the detected current, integrating it for one period and outputting a corresponding work operation value (Wi) (step ST22); comparing the work operation value (Wi) and a previous work operation value (Wi) and outputting a variation amount of the compared work operation values (step ST23); outputting a switching control signal having a duty ratio of the current time point if the variation amount of the work operation value is more than a predetermined value (step ST24); and switching the AC power with the triac according to the switching control signal, applying the stroke voltage to the linear compressor and driving the linear compressor (step ST25).

In the step (ST23) of comparing the work operation signals, if the difference between the current work operation value and the previous work operation value is less than the predetermined value, a step (ST26) of increasing a duty ratio of the switching control signal is additionally included.

The switching control signal controls the ON/OFF period of the triac by using a work operation value corresponding to the current when the TDC is '0'.

Meanwhile, in a different embodiment of the present invention, the work operation value (W) is computed by integrating the product of the current consumed by the compressor and the displacement size operated through the sensorless circuit, and the linear compressor can be driven by using the variation information of the size of the work operation value (W), which will be described in detail with reference to FIG. 9.

Figure 9:
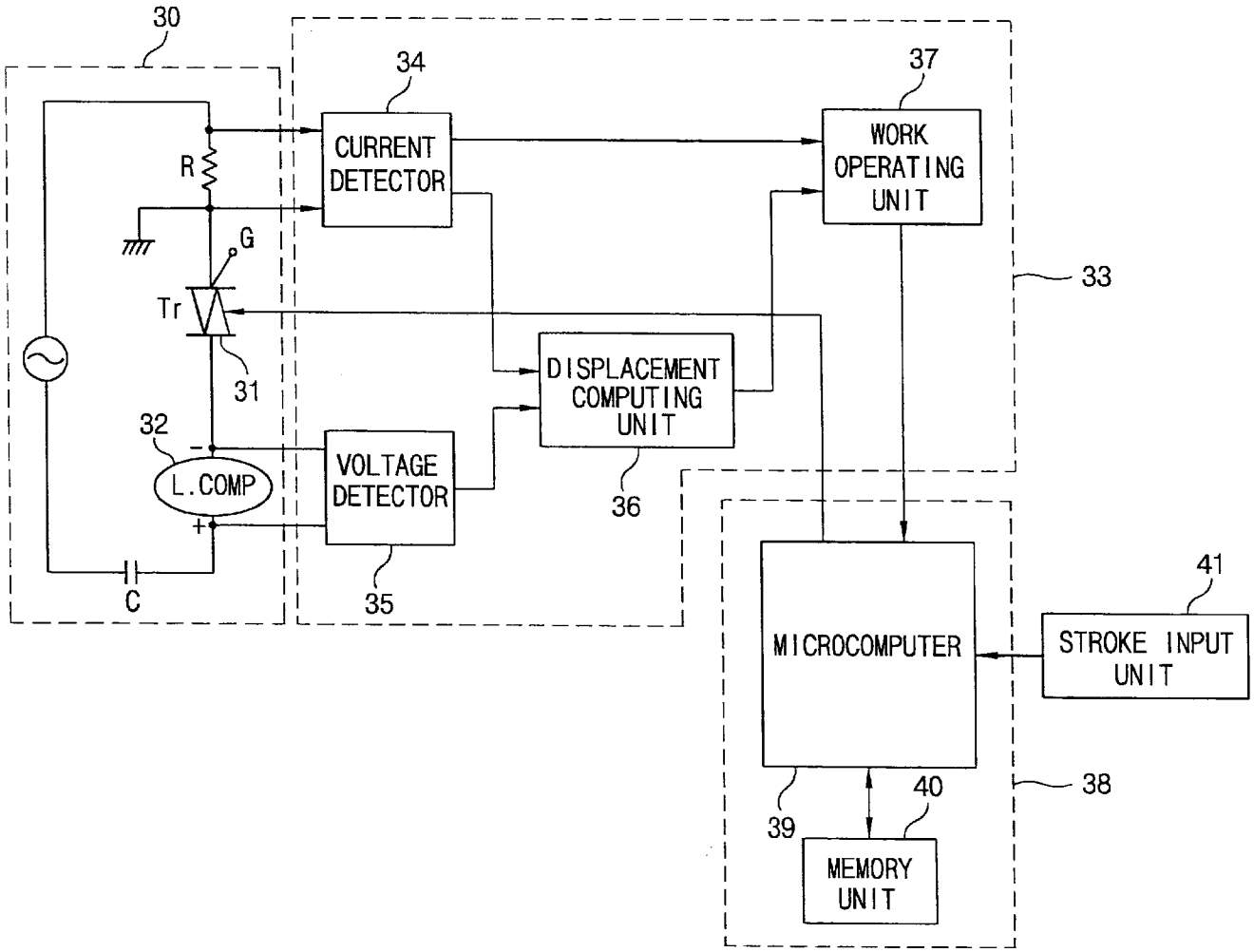
FIG. 9 is a schematic block diagram showing the construction of an apparatus for controlling an operation of a linear compressor in accordance with a third embodiment of the present invention.

FIG. 9 is a schematic block diagram showing the construction of an apparatus for controlling an operation of a linear compressor in accordance with a third embodiment of the present invention.

As shown in FIG. 9, a sensorless circuit unit 33, detecting a current and a voltage applied to the linear compressor 32 and outputting a corresponding work operation signal, includes a current detector 34 for detecting a current applied to the linear compressor 32; a voltage detector 35 for detecting a voltage generated from the linear compressor 32; a displacement computing unit 36 for receiving the current and the voltage, computing and outputting a displacement; and a work operating unit 37 for receiving the displacement and the current of the current detector, operating them, and outputting a corresponding work operation value.

A stroke controller 38, receiving the work operation value and outputting a corresponding switching control signal, includes a memory unit 40 for sequentially storing work operation values of the work operating unit 37 and a microcomputer 39 for receiving a previous work operation value and the predetermined work operation value outputted from the work operating unit, comparing them, and outputting a corresponding switching control signal.

As shown in FIG. 9, an apparatus for controlling an operation of a linear compressor in accordance with a third embodiment of the present invention includes: a stroke input unit 41 for outputting a predetermined stroke command value according to a user's input; a linear compressor 32 for varying a stroke according to a reciprocal movement of a piston and controlling a cooling force; a current detector 34 for detecting and outputting a current applied to the linear compressor 32; a voltage detector 35 for detecting and outputting a voltage generated from the linear compressor; a displacement computing unit 36 for receiving the current and the voltage, computing a displacement and outputting it; a work operating unit 37 for receiving the displacement and the current, multiplying the current and the displacement together, integrating the multiplied value, and outputting the integrated value to the work operation value (W); a memory unit 40 for sequentially storing work operation values of the work operating unit 37; a microcomputer 39 for receiving a previous work operation value outputted from the memory unit 40 and the predetermined work operation value outputted from the work operating unit 37, comparing them, and outputting a corresponding switching control signal; and an electric circuit unit 30 for switching an AC power with the triac 31 according to the switching control signal of the microcomputer 39 and applying a stroke voltage to the linear compressor 32.

The operation of the apparatus for controlling an operation of a linear compressor 32 constructed as described above will now be explained.

First, in the linear compressor 32, the piston is reciprocally moved by the stroke voltage according to the stroke command value set by the user, according to which the stroke is varied to control a cooling force.

That is, when the stroke is increased as the ON period of the triac 31 of the electric circuit unit 30 is lengthened according to the switching control signal of the microcomputer 39, the linear compressor 32 is driven by the stroke.

At this time, the current detector 34 and the voltage detector 35 detect the current and the voltage generated from the linear compressor and apply them to the displacement computing unit 36, respectively, and accordingly, the displacement computing unit 36 computes and outputs a displacement with the detected current of the current detector 34 and the detected voltage of the voltage detector 35.

The work operating unit 37 receives the displacement of the displacement computing unit 36 and the detected current from the current detector 34, multiplies the current and the displacement together, integrates the multiplied value, and outputs the integrated value as a work operation value (W), which can be expressed by equation (2), shown below:

$$W=\int |i|\times|s|, \text{ integration section is in the unit of } 1/60 \text{ seconds} \quad (2)$$

Figure 10:
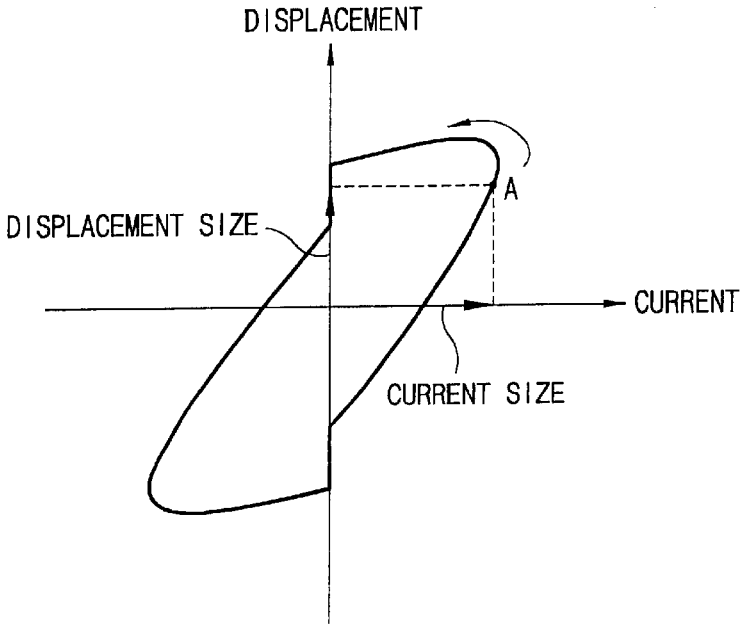
FIG. 10 is an exemplary view showing a trajectory of a current and a displacement according to the lapse of time, after the linear compressor is initiated in accordance with the third embodiment of the present invention.

FIG. 10 is an exemplary view showing a trajectory of a current and a displacement according to the lapse of time, after the linear compressor is initiated in accordance with the third embodiment of the present invention.

As shown in FIG. 10, 'A' is one point of a trajectory corresponding to the current and the displacement, and the movement of the trajectory for the current and the displacement is repeated by every 1/60 seconds by being synchronized with a power supply frequency supplied to the linear compressor 32.

Thereafter, the microcomputer 39 receives the work operation value (W) of the work operating unit, compares it with the previous work operation value (W) and outputs a corresponding switching control signal.

Figure 11:
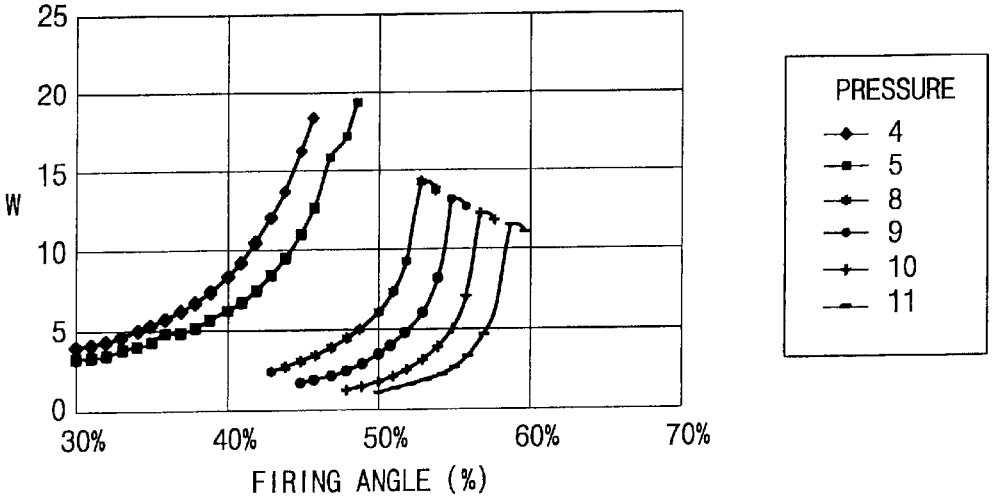
FIG. 11 is a graph illustrating a point where a TDC is '0' in accordance with the third embodiment of the present invention.

FIG. 11 is a graph illustrating a point where a TDC is '0' in accordance with the third embodiment of the present invention.

As shown in FIG. 11, there is a point where a difference between the current work operation value (W) and the previous work operation value (W) is sharply increased more than a predetermined value, and according to an experiment, the point was where the TDC is '0'.

Figure 12:
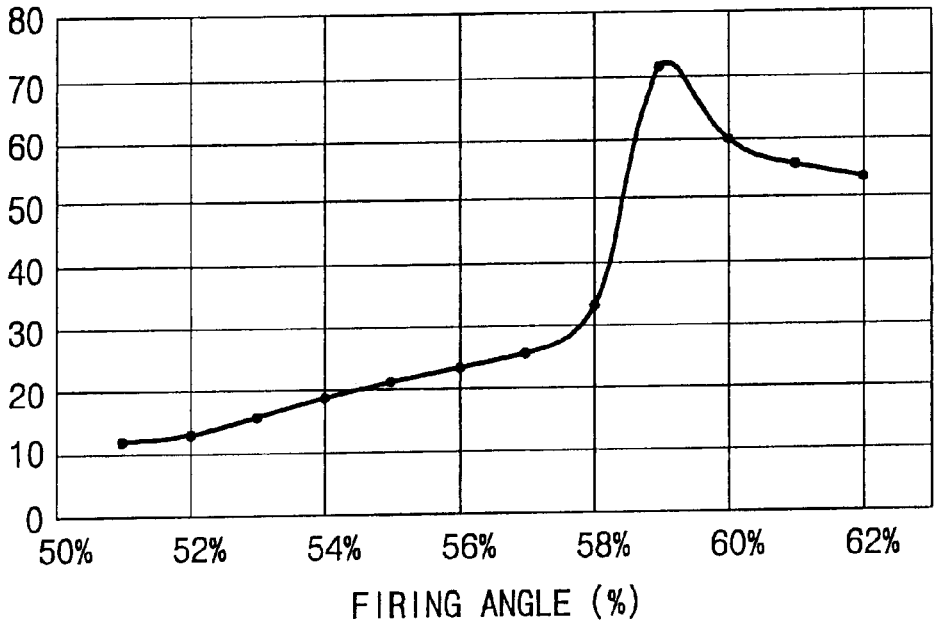
FIG. 12 is a graph showing a variation of a work operation signal according to increase of a duty ratio of a switching control signal in accordance with the third embodiment of the present invention.

FIG. 12 is a graph showing a variation of a work operation signal according to increase of a duty ratio of a switching control signal in accordance with the third embodiment of the present invention.

Accordingly, the microcomputer 39 compares the current work operation value (W) and the previous work operation value (W), and if a difference between them is less than a predetermined value, the microcomputer 39 outputs the switching control signal while gradually increasing its duty ratio, and then, if the difference between the current work operation value and the previous work operation value goes beyond the predetermined value, the microcomputer 39 maintains the switching control signal having a duty ratio of the current time point and outputs it.

Thereafter, the electric circuit unit 30 switches the AC power with the triac 31 according to the switching control signal of the microcomputer 39 and applies a corresponding stroke voltage to the linear compressor 32, thereby controlling the operation of the linear compressor 32.

That is, in this embodiment, the area of a trajectory varied corresponding to the current and the displacement generated in the operation of the linear compressor 32 is recognized as a work operation value while increasing a duty ratio of the switching control signal applied to the triac 31 of the electric circuit unit 30, and thereafter, the time point when a work operation value (Wi) is sharply increased higher than the previous work operation value (Wi) is recognized as a point where the TDC is '0', and the ON/OFF period of the triac 21 is controlled with the switching control signal at the time point, thereby controlling the operation of the linear compressor.

Figure 13:
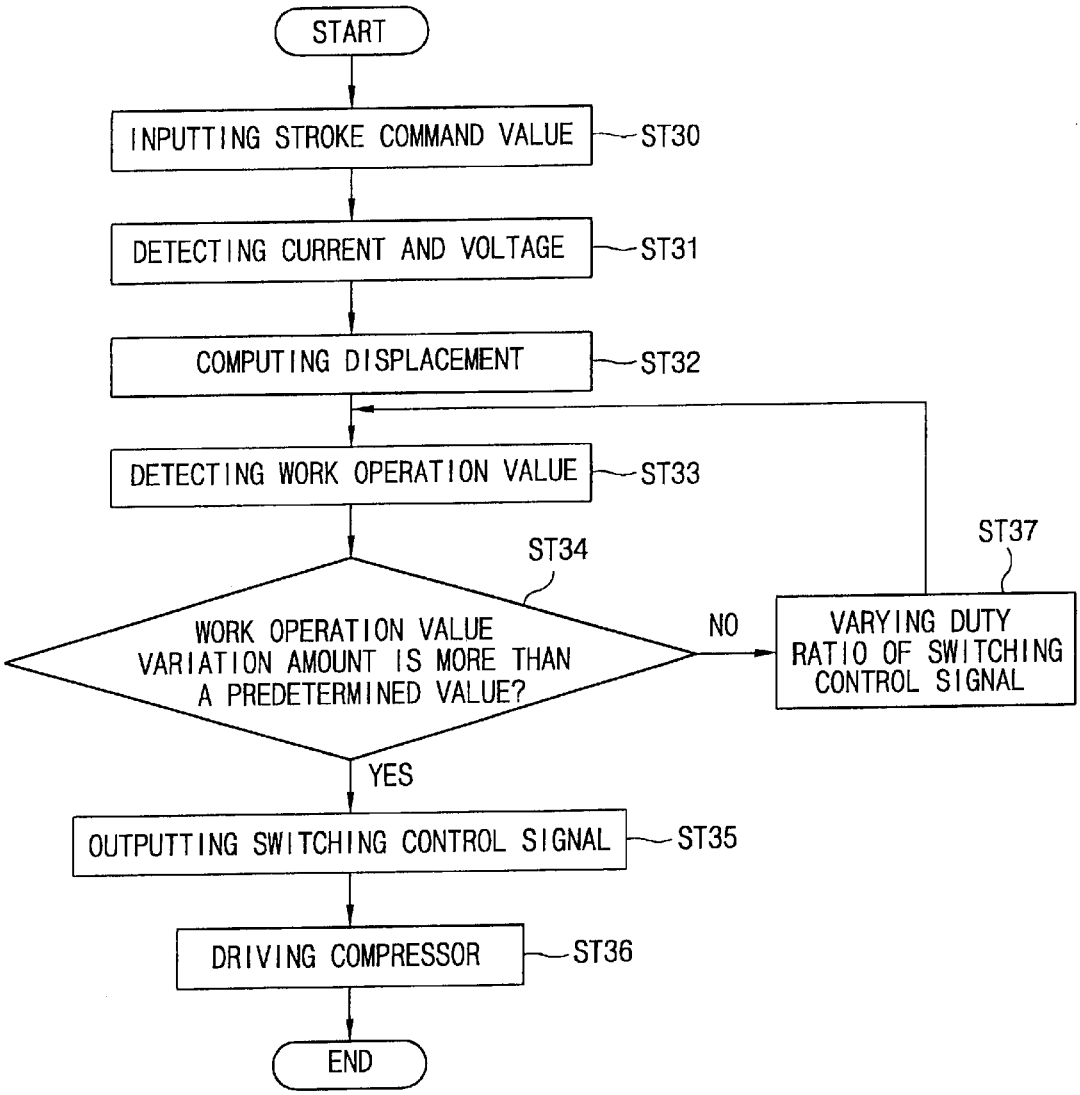
FIG. 13 is a flow chart of a driving method of the linear compressor for obtaining a work operation value by using an input current and a displacement and controlling a stroke with the variation amount of the size of the work operation value.

FIG. 13 is a flow chart of a driving method of the linear compressor for obtaining a work operation value by using an input current and a displacement and controlling a stroke with the variation amount of the size of the work operation value.

As shown in FIG. 13, a driving method of the linear compressor includes the steps of: outputting a stroke command value according to user's input information (step ST30); outputting a current and a voltage generated when the linear compressor 32 is driven by the stroke voltage (step ST31); receiving the detected current and the voltage and computing a displacement (step ST32); receiving the displacement and the detected current, multiplying the current and the displacement together, integrating the multiplied value, and outputting the integrated value as a work operation value (step ST33); receiving the work operation value (W), comparing it with a previous work operation value (W) and outputting a variation amount of the work operation value (step ST34); outputting a switching control signal having a duty ratio of the current time point if the variation amount of the work operation value is more than a predetermined value (step ST35); and switching an AC power with the triac 31 according to the switching control signal, applying a stroke voltage to the linear compressor 32, and driving the compressor (step S36).

In the work operation value comparing step (step ST34), if the variation amount of the work operation value is less than the predetermined value, a step (ST37) of increasing the duty ratio of the switching control signal is further included.

The switching control signal controls the ON/OFF period of the triac 31 by using a work operation value corresponding to the current and the displacement when the TDC is '0'.

Meanwhile, in a different embodiment of the present invention, the work operation value ($W_h$) is computed by integrating the product of the current consumed by the compressor and the displacement size operated through the sensorless circuit, and the linear compressor can be driven by using the variation information of the size of the work operation value ($W_h$), which will be described in detail with reference to FIG. 14.

Figure 14:
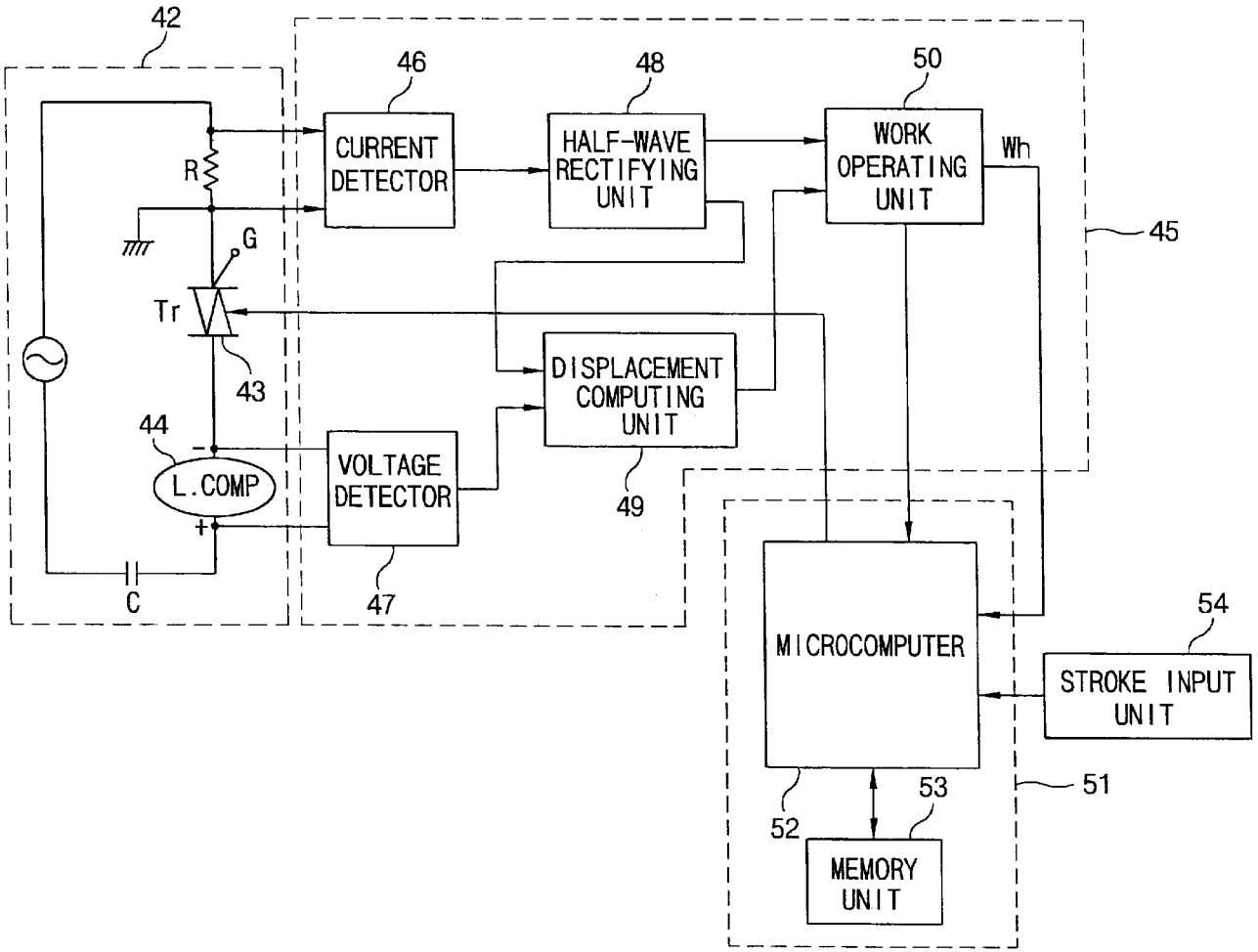
FIG. 14 is a schematic block diagram showing the construction of an apparatus for controlling an operation of a linear compressor in accordance with a fourth embodiment of the present invention.

As shown in FIG. 14, a sensorless circuit unit 45, detecting a current and a voltage applied to the linear compressor 44 and outputting a corresponding work operation signal, includes a current detector 46 for detecting a current applied to the linear compressor 44; a voltage detector 47 for detecting a voltage generated from the linear compressor 44; a half-wave rectifying unit 48 for half-wave rectifying the detected current received from the current detector 46 and outputting a corresponding half-wave current; a displacement computing unit 49 for receiving the voltage outputted from the voltage detector 47 and the half-wave current outputted from the half-wave rectifying unit 48, computing and outputting a displacement; and a work operating unit 50 for receiving the displacement of the displacement computing unit 49 and the half-wave current of the half-wave rectifying unit 48, operating them, and outputting a corresponding work operation value.

A stroke controller 51, receiving the work operation value and outputting a corresponding switching control signal, includes a memory unit 53 for sequentially storing the work operation value of the work operating unit 50; and a microcomputer 52 for receiving a previous work operation value outputted from the memory unit 53 and the predetermined work operation value outputted from the work operating unit, comparing them, and outputting a corresponding switching control signal FIG. 14 is a schematic block diagram showing the construction of an apparatus for controlling an operation of a linear compressor in accordance with a fourth embodiment of the present invention.

As shown in FIG. 14, the apparatus for controlling an operation of a linear compressor includes: a stroke input unit 54 for outputting a predetermined stroke command value according to a user's input; a linear compressor 44 for varying a stroke according to a reciprocal movement of a piston and controlling a cooling force; a current detector 46 for detecting a current applied to the linear compressor; a voltage detector 47 for detecting a voltage generated from the linear compressor; a half-wave rectifying unit 48 for half-wave rectifying the detected current received from the current detector 48 and outputting a corresponding half-wave current; a displacement computing unit 49 for receiving the voltage from the voltage detector 47 and the half-wave current outputted from the half-wave rectifying unit 48, and computing a displacement; a work operating unit 50 for receiving the displacement from the displacement computing unit 49 and a positive current of the half-wave rectifying unit 48, multiplying the current and the displacement together, integrating the multiplied value, and outputting the integrated value as a work operation value ($W_h$); a memory unit 53 for sequentially storing the work operation values of the work operating unit 50; a microcomputer 52 for receiving a previous work operation value outputted from the memory unit 53 and the predetermined work operation value outputted from the work operating unit, comparing them, and outputting a switching control signal according to the variation amount of the work operation value; and an electric circuit unit 42 for switching an AC power with a triac 43 according to the switching control signal of the microcomputer 52 and applying a stroke voltage to the linear compressor 44.

The operation of the apparatus for controlling an operation of the linear compressor 11 constructed as described above will now be explained.

First, in the linear compressor 44, the piston is reciprocally moved by the stroke voltage according to the stroke command value set by the user, according to which the stroke is varied to control a cooling force.

That is, when the stroke is increased as the ON period of the triac 43 of the electric circuit unit 42 is lengthened according to the switching control signal of the microcomputer 52, the linear compressor 44 is driven by the stroke.

At this time, the current detector 46 and the voltage detector 47 detect the current and the voltage generated from the linear compressor 44

Considering that a trajectory of the current and the displacement is symmetric vertically and horizontally, a positive current and a negative current are obtained with a diode, and a TDC controlling is performed by using the characteristics of the positive current and the negative current.

A half-wave rectifying unit 48 receives the current of the current detector 46, half-wave rectifies it, and applies a corresponding positive current to the displacement computing unit 49. And then, the displacement computing unit 49 computes and outputs a displacement by using the voltage detected by the voltage detector 47 and the positive current of the half-wave rectifying unit 48.

The work operating unit 50 receives the displacement of the displacement computing unit 49 and the positive current of the half-wave rectifying unit 48, multiplies the current and the displacement together, integrates the multiplied value, and outputs the integrated value as a work operation value ($W_h$), which can be expressed by equation (3) shown below:

$$W_h = \int |i| \times |s|, \text{ integration section is a part where the current is '+' in the unit of } 1/60 \text{ seconds} \quad (3)$$

Figure 15:
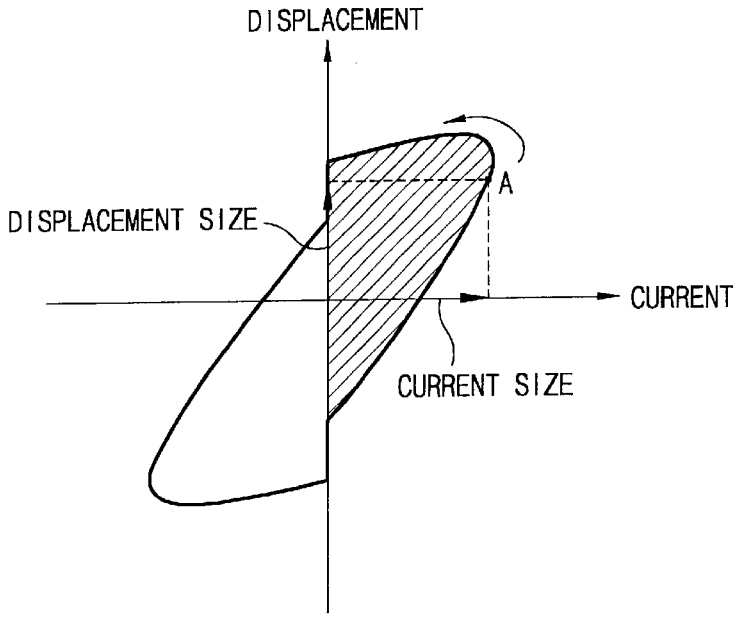
FIG. 15 is an exemplary view showing a trajectory of a current and a displacement according to the lapse of time, after the linear compressor is initiated in accordance with the fourth embodiment of the present invention.

FIG. 15 is an exemplary view showing a trajectory of a current and a displacement according to the lapse of time, after the linear compressor is initiated in accordance with the fourth embodiment of the present invention.

As shown in FIG. 15, 'A' is one point of a trajectory corresponding to the current and the displacement, and the movement of the trajectory for the current and the displacement is repeated only at the part where the current is '+' in 1/60 seconds by being synchronized with a power supply frequency supplied to the linear compressor 44.

Thereafter, the microcomputer 52 receives the work operation value ($W_h$) of the work operating unit, compares it with the previous work operation value ($W_h$) and outputs a corresponding switching control signal.

Figure 16:
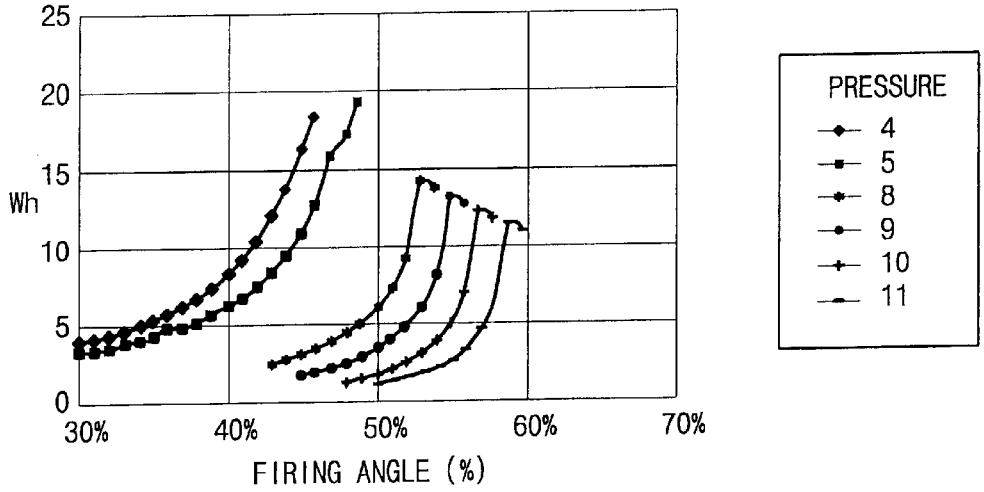
FIG. 16 is a graph illustrating a point where a TDC is '0' in accordance with the fourth embodiment of the present invention.

FIG. 16 is a graph illustrating a point where a TDC is '0' in accordance with the third embodiment of the present invention.

As shown in FIG. 16, there is a point where a difference between the current work operation value ($W_h$) and the previous work operation value ($W_h$) is sharply increased more than a predetermined value, and according to an experiment, the point was where the TDC is '0'.

Accordingly, the microcomputer 52 compares the current work operation value ($W_h$) and the previous work operation value ($W_h$), and if a difference between them is less than a predetermined value, the microcomputer 52 outputs the switching control signal while gradually increasing its duty ratio, and then, if the difference between the current work operation value and the previous work operation value goes beyond the predetermined value, the microcomputer 52 maintains the switching control signal having a duty ratio of the current time point and outputs it.

Thereafter, the electric circuit unit 42 switches the AC power with the triac according to the switching control signal of the microcomputer 52 and applies a corresponding stroke voltage to the linear compressor 44, thereby controlling the operation of the linear compressor 44.

That is, in this embodiment, an area of the part where the current is '+' out of the area of a trajectory varied corresponding to the current and the displacement generated in the operation of the linear compressor 32 is obtained and recognized as a work operation value while increasing a duty ratio of the switching control signal applied to the triac 31 of the electric circuit unit 30, and thereafter, the time point when a work operation value (Wi) is sharply increased higher than the previous work operation value (Wi) is recognized as a point where the TDC is '0', and the ON/OFF period of the triac 21 is controlled with the switching control signal at the time point, thereby controlling the operation of the linear compressor.

Figure 17:
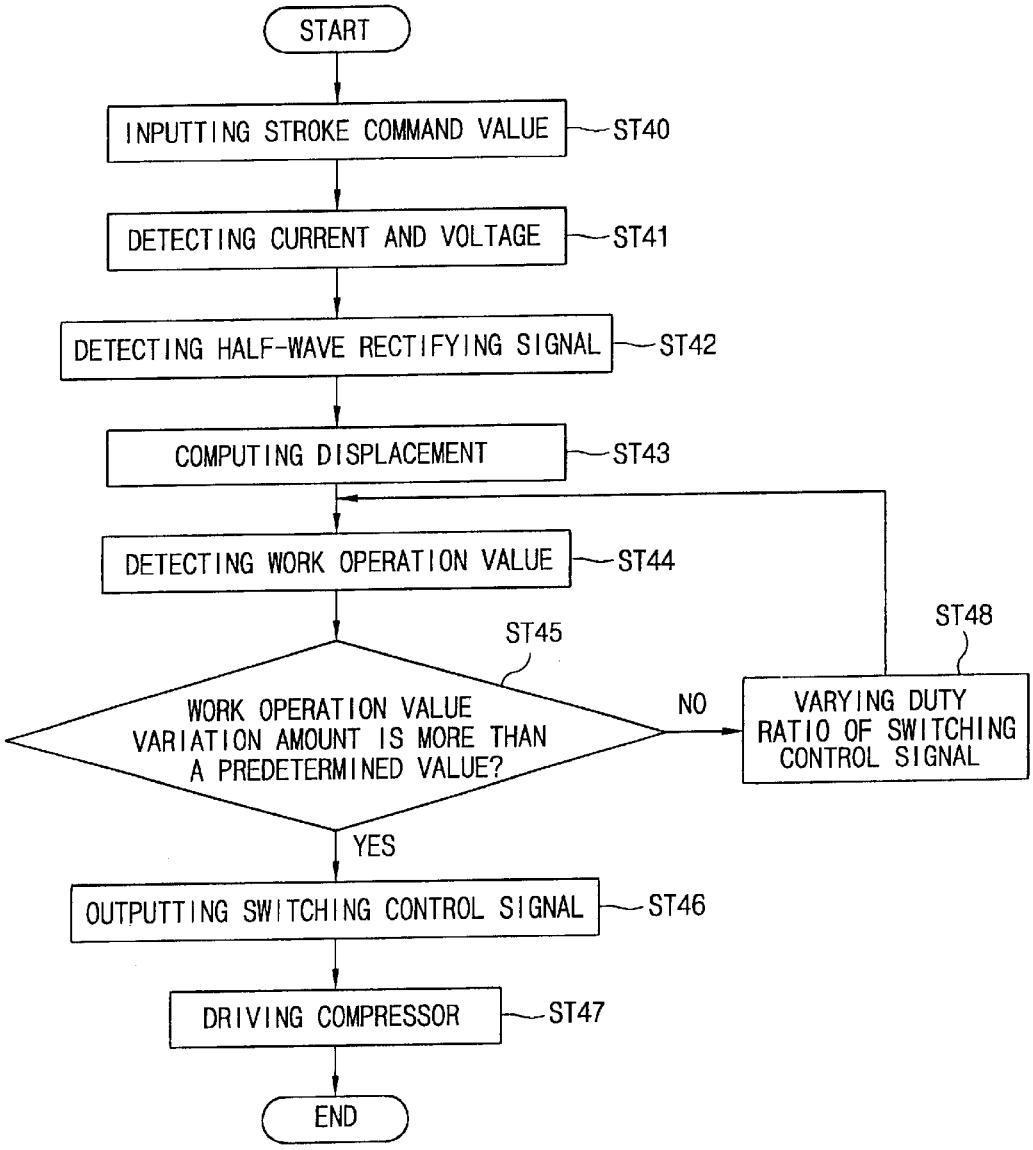
FIG. 17 is a flow chart of a driving method of the linear compressor for obtaining a work operation value by using a half-wave current and a displacement and controlling a stroke by using the variation amount of the work operation value in accordance with the fourth embodiment of the present invention.

FIG. 17 is a flow chart of a driving method of the linear compressor for obtaining a work operation value by using a half-wave current and a displacement and controlling a stroke by using the variation amount of the work operation value in accordance with the fourth embodiment of the present invention.

As shown in FIG. 17, a driving method of a linear compressor includes the steps of: outputting a stroke command value according to user's input information (step ST 40); outputting a current and a voltage generated when a linear compressor is driven by a stroke voltage (step ST41); half-wave rectifying the detected current and outputting a corresponding half-wave current (step ST42); receiving the detected voltage and the half-wave current, computing and outputting the displacement (step ST43); receiving the displacement and the half-wave current, multiplying the half-wave current and the displacement together, integrating the multiplied value, and outputting the integrated value as a work operation value (W) (step ST44); receiving the work operation value (W), comparing it with a previous work operation value (W), and outputting a variation amount of the work operation value (step ST45); outputting a switching control signal having a duty ratio of the current time point if the variation amount of the work operation value is more than a predetermined value (step S46); and switching an AC power with a triac according to the switching control signal, and applying a stroke voltage to the linear compressor to drive the linear compressor (step ST47).

In the work operation value comparing step (step ST45), if the variation amount of the work operation value is less than the predetermined value, a step (ST48) of increasing the duty ratio of the switching control signal is further included.

The switching control signal controls the ON/OFF period of the triac 43 by using a work operation value corresponding to the current and the displacement when the TDC is '0', and the half-wave current may be a positive current or a negative current obtained from the detected current by using a diode.

Meanwhile, in a different embodiment of the present invention, the work operation value (W) is computed by integrating the product of the current consumed by the compressor and the displacement size operated through the sensorless circuit, and a gain value is detected by using the variation amount of the work operation value (W), so that the linear compressor can be driven by using a quantitative behavior of the piston, which will now be described in detail with reference to FIG. 18.

Figure 18:
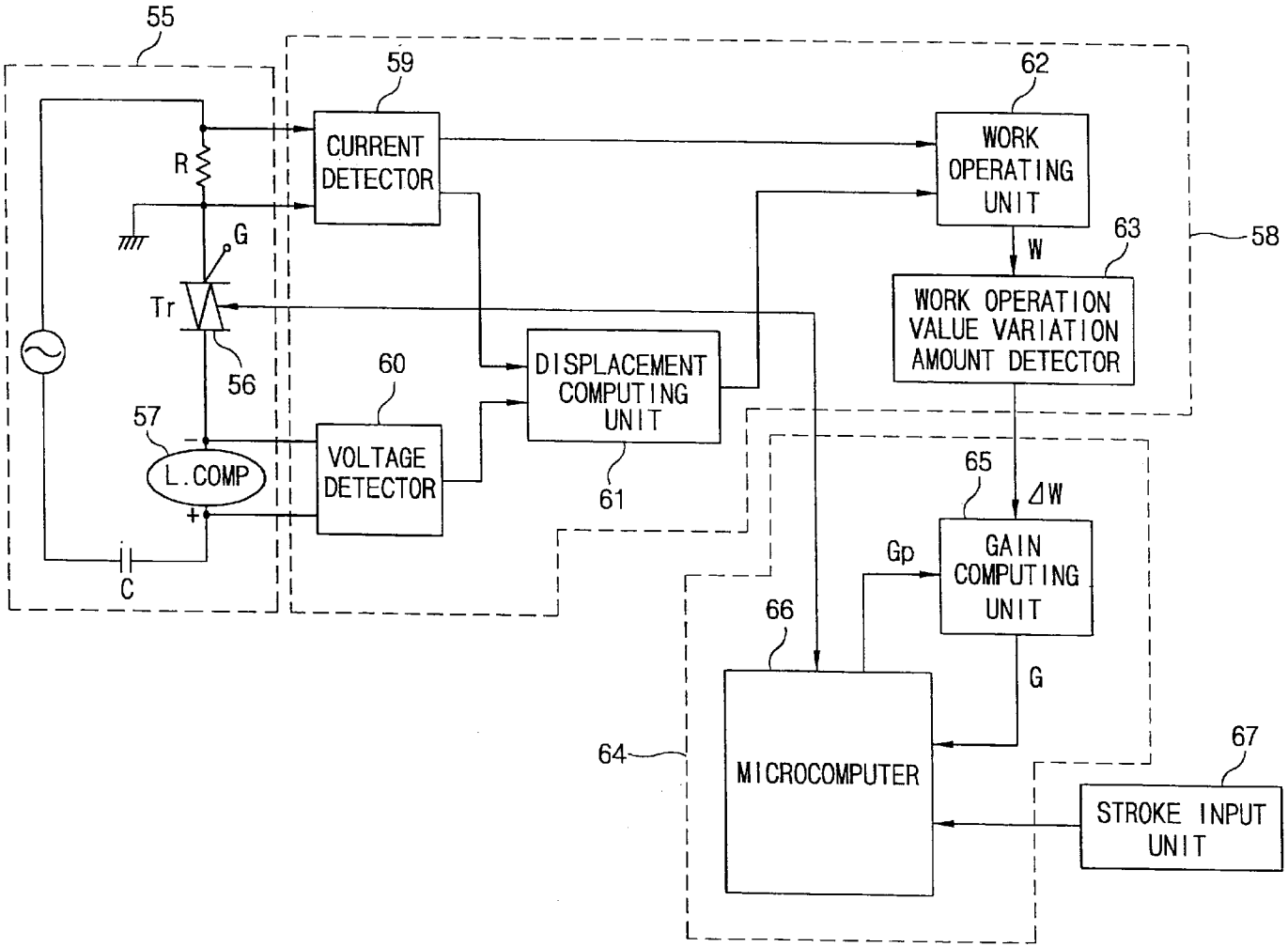
FIG. 18 is a schematic block diagram showing the construction of an apparatus for controlling an operation of a linear compressor in accordance with a fifth embodiment of the present invention.

As shown in FIG. 18, a sensorless circuit unit 58, detecting a current and a voltage applied to the linear compressor 57 and outputting a corresponding work operation signal, includes a current detector 59 for detecting a current applied to the linear compressor 57; a voltage detector 60 for detecting a voltage generated from the linear compressor 57; a displacement computing unit 61 for receiving the current and the voltage and computing a displacement; a work operating unit 62 for receiving the displacement and the current, multiplying the current and the displacement, integrating the multiplied value, and outputting the integrated value as a work operation value (W); and a work operation value variation amount detector 63 for receiving the work operation value (W) from the work operating unit 62, comparing it with a previous work operation value (W), and detecting a corresponding work operation value variation amount (ΔW).

A stroke controller 64, receiving the work operation value variation amount and outputting a corresponding switching control signal, includes a gain computing unit 65 for receiving the work operation value variation amount (ΔW), from the work operation value variation amount detector 63 and a previous gain (Gp), operating them and computing a corresponding gain (G); and a microcomputer 66 for receiving the gain (G) from the gain computing unit 65, outputting a switching control signal with a duty ratio increased as much as the gain (G), and at the same time, applying the gain (G) as a previous gain (Gp) to the gain computing unit 65.

FIG. 18 is a schematic block diagram showing the construction of an apparatus for controlling an operation of a linear compressor in accordance with a fifth embodiment of the present invention.

As shown in FIG. 18, the apparatus for controlling an operation of a linear compressor includes: a stroke input unit 67 for outputting a predetermined stroke command value according to a user's input; a linear compressor 57 for varying a stroke according to a reciprocal movement of a piston and controlling a cooling force; a current detector 59 for detecting a current applied to the linear compressor; a voltage detector 60 for detecting a voltage generated from the linear compressor; a displacement computing unit 61 for receiving the current and the voltage, and computing a displacement; a work operating unit 62 for receiving the displacement and the current, multiplying the current and the displacement, integrating the multiplied value, and outputting the integrated value as a work operation value (W); a work operation value variation amount detector 63 for receiving the work operation value (W) of the work operating unit, comparing it with a previous work operation value (W), and detecting a corresponding work operation value variation amount (ΔW); a gain computing 65 for receiving the work operation value variation amount (ΔW) of the work operation value variation amount detector 63 and a previous gain (Gp), operating them, and computing a corresponding gain (G); a microcomputer 66 for receiving the gain (G) from the gain computing unit 65, outputting a switching control signal having a duty ratio increased as much as the gain (G), and at the same time, applying the gain (G) and a previous gain (Gp) to the gain computing unit; and an electric circuit unit 55 for switching an AC power with a triac 56 according to the switching control signal of the microcomputer 66, and applying a stroke voltage to the linear compressor 57.

The work operation value variation amount detector 63 includes a memory (not shown) for sequentially storing the work operation value of the work operating unit .

The operation of the apparatus for controlling an operation of the linear compressor (11) constructed as described above will now be explained.

First, in the linear compressor 57, the piston is reciprocally moved by the stroke voltage according to the stroke command value set by the user, according to which the stroke is varied to control a cooling force.

That is, when the stroke is increased as the ON period of the triac 56 of the electric circuit unit is lengthened according to the switching control signal of the microcomputer 66, the linear compressor 57 is driven by the stroke.

At this time, the current detector 59 and the voltage detector 6 -detect the current and the voltage generated from the linear compressor 57

The work operating unit 62 receives the displacement of the displacement computing unit 61 and the current of the current detector 59, multiplies the current and the displacement together, integrates the multiplied value, and outputs the integrated value as a work operation value (W), which can be expressed by equation (4) shown below:

$$W_h=\int|i|\times|s|, \text{ integration section is in the unit of } 1/60 \text{ seconds} \quad (4)$$

Thereafter, the work operation value variation amount detector 63 receives the work operation value from the work operating unit 62, compares it with a previous work operation value, detects a corresponding work operation value variation amount to the gain computing unit 65.

Accordingly, the gain computing unit 65 receives the work operation value variation amount (ΔW) of the work operation variation amount detector 63 and a previous gain (Gp), operates them, and computes a corresponding gain (G).

That is, if the work operation value variation amount inputted from the work operating unit 62 is less than a predetermined value, the gain computing unit 65 divides the previous gain (Gp) by the work operation value variation amount (ΔW), multiplies the divided value by a predetermined constant value (a tuning gain) and takes the resulted value as a gain (G).

If, however, the work variation amount (ΔW) inputted from the work operating unit 62 is more than the predetermined value or smaller than '0', the gain is outputted as '0', to thereby automatically control the gain.

Figure 19:
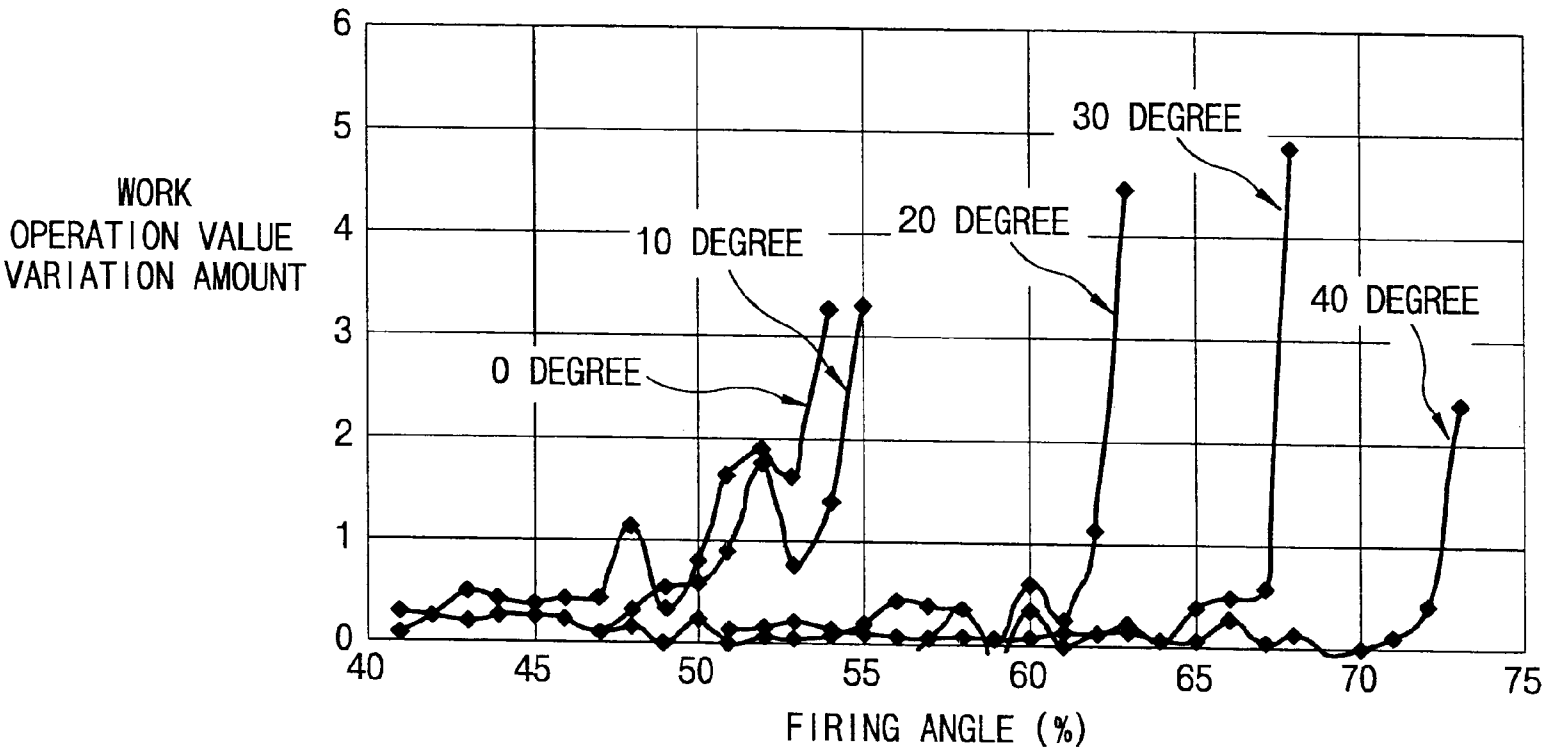
FIG. 19 is a graph showing a variation amount of a work operation value according a switching control signal and a variation of an external temperature in accordance with the fifth embodiment of the present invention.

FIG. 19 is a graph showing a variation amount of a work operation value according a switching control signal and a variation of an external temperature in accordance with the fifth embodiment of the present invention.

As shown in FIG. 19, it is noted that only in case that the work operation value variation amount is at least higher than '2', the linear compressor can be operated at the point where the TDC=0.

Thereafter, the microcomputer receives the gain of the gain computing unit 65, outputs a switching control signal having a duty ratio increased as much as the gain, so that the linear compressor can be operation at the point where the TDC=0, and at the same time, applies the gain (G) as a previous gain (Gp) to the gain computing unit 65.

Thereafter, the electric circuit unit 55 switches an AC power with the triac 56 according to the switching control signal of the microcomputer, applies a stroke voltage to the linear compressor 57, and controls the operation of the linear compressor 57.

That is, in this embodiment of the present invention, a gain for increasing a duty ratio of the switching control signal applied to the triac 56 of the electric circuit unit 55 with the variation amount of an area of a trajectory varied corresponding to the current and the displacement generated when the linear compressor 57, and then the gain is automatically varied to precisely detect a point where the TDC is '0', so that the linear compressor 57 can be continuously operated around the point where the TDC is '0'.

Figure 20:
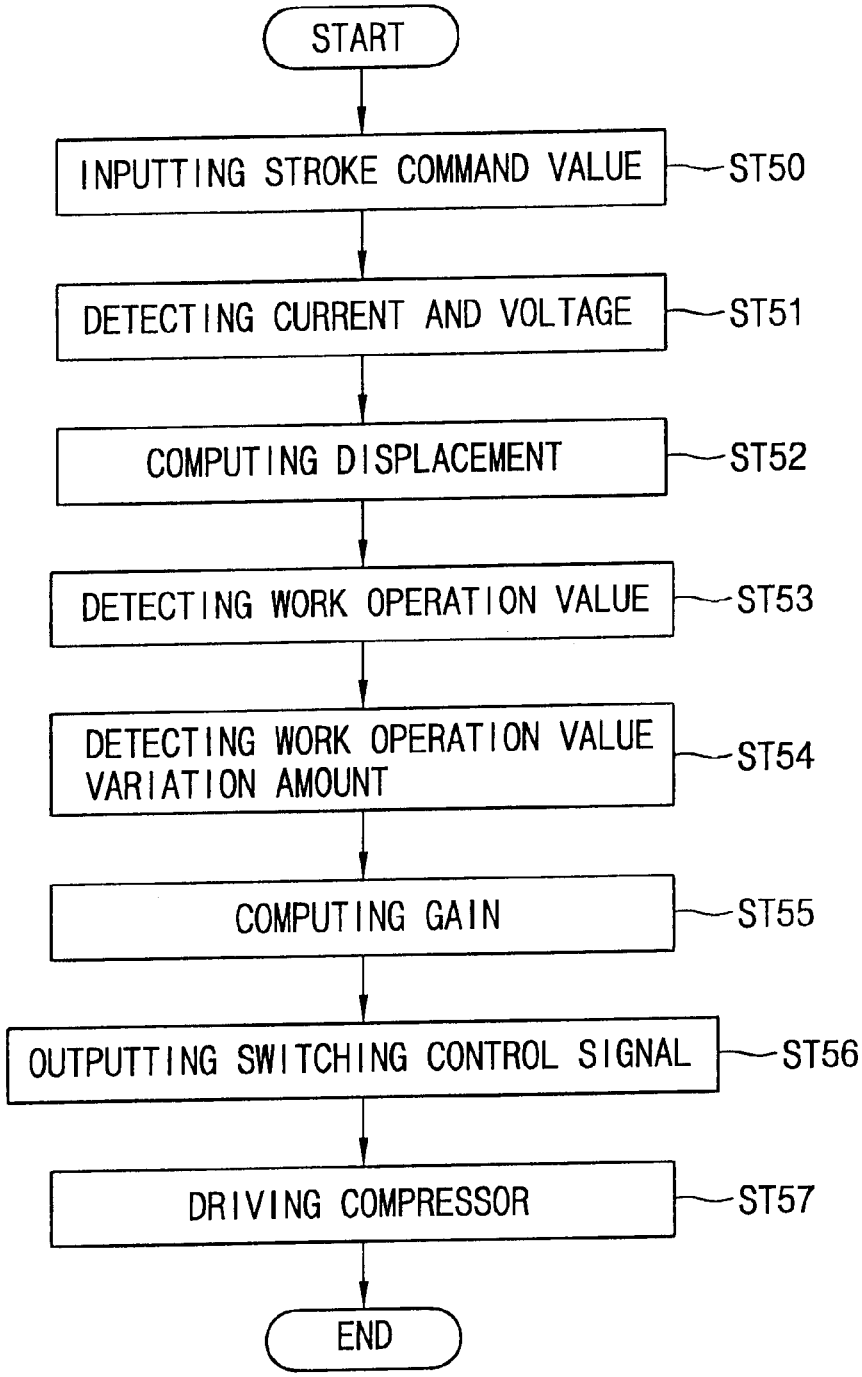
FIG. 20 is a flow chart of a method for controlling an operation of a linear compressor controlling a stroke according to a gain value detected by using a variation amount of a work operation value obtained by integrating a value obtained by multiplying an input current and a displacement size together.

FIG. 20 is a flow chart of a method for controlling an operation of a linear compressor controlling a stroke according to a gain value detected by using a variation amount of a work operation value obtained by integrating a value obtained by multiplying an input current and a displacement size together.

As shown in FIG. 20, a method for controlling an operation of a linear compressor includes the steps of: inputting a stroke command value according to user's input information (step ST 50); outputting a current and a voltage generated when a linear compressor 57 is driven by a stroke voltage (step ST51); receiving the detected current and voltage and computing and outputting the displacement (step ST52); receiving the displacement and the current, multiplying the current and the displacement together, integrating the multiplied value, and outputting the integrated value as a work operation value (W) (step ST53); receiving the work operation value (W), comparing it with a previous work operation value (W), and outputting a corresponding variation amount of the work operation value (step ST54); receiving the work operation value variation amount and a previous gain (Gp), operating them, and computing a corresponding gain (G) (step ST55); receiving the gain and outputting a switching control signal having a duty ratio increased as much as the gain (step ST56); and switching an AC power with the triac 56 according to the switching control signal, applying a stroke voltage to the linear compressor 57, and driving the compressor (step ST57).

In the gain computing step (ST55), if the work operation value variation amount is less than a predetermined value, the previous gain is divided by the work operation value variation amount and multiplies the divided value by a predetermined constant value (tuning gain), and then thusly obtained value is taken as a gain (G). If, however, the inputted work operation value variation amount is more than a predetermined value or less than '0', the gain is outputted as '0', thereby automatically controlling the gain.

As so far described, the apparatus and method for controlling an operation of a linear compressor of the present invention has the following advantages.

That is, in operating the linear compressor, in order to detect the non-linear characteristic according to the mechanical characteristic, the stroke is controlled in the following manners.

First, the stroke is controlled with a variation amount of a size of a work operation value after recognizing the work operation value which is obtained by integrating the size of the current consumed by the linear compressor.

Secondly, the stroke is controlled with a variation amount of a size of a work operation value by recognizing the work operation value which is obtained by integrating the product of an input current and a displacement.

Thirdly, the stroke is controlled with a variation amount of a size of a work operation value after recognizing the work operation value which is obtained by integrating the product of a positive current obtained by half-wave rectifying an input current and a size of a displacement, in consideration of the fact that a trajectory for the current and the displacement is symmetrical horizontally and vertically.

Lastly, the stroke is controlled with a gain value detected by using a variation amount of a work operation value which is obtained by integrating the product of an input current and a displacement size.

Accordingly, the TDC of the piston in consideration of an error due to the nonlinear characteristic can be controlled, and thus, the operation efficiency of the linear compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A method for controlling an operation of a linear compressor comprising the steps of:

outputting a stroke command value according to user's input information;

outputting a current and a voltage generated when the linear compressor 32 is driven by the stroke voltage;

receiving the detected current and the voltage and computing a displacement;

receiving the displacement and the detected current, multiplying the current and the displacement together, integrating the multiplied value, and outputting the integrated value as a work operation value;

receiving the work operation value (W), comparing it with a previous work operation value (W) and outputting a variation amount of the work operation value;

outputting a switching control signal having a duty ratio of the current time point if the variation amount of the work operation value is more than a predetermined value; and switching an AC power with the triac 31 according to the switching control signal, applying a stroke voltage to the linear compressor 32, and driving the compressor.

2. The method of claim 1, wherein the work operation value comparing step includes a step of increasing the duty ratio of the switching control signal, if the variation amount of the work operation value is less than the predetermined value.

3. The method of claim 1, wherein the switching control signal controls the ON/OFF period of the triac 31 by using a work operation value corresponding to the current and the displacement when the TDC is '0'.

* * * * *